US009561537B2

(12) United States Patent
Kirby et al.

(10) Patent No.: US 9,561,537 B2
(45) Date of Patent: Feb. 7, 2017

(54) PROCESS FOR UPSET FORGING OF DRILL PIPE AND ARTICLES PRODUCED THEREBY

(71) Applicant: Hunting Energy Services, Inc., Forth Worth, TX (US)

(72) Inventors: Klane Edward Kirby, Moore, OK (US); Gregory Lynn Adkins, Lafayette, LA (US)

(73) Assignee: Hunting Energy Services, Inc., Houston, TX (US)

( * ) Notice: Subject to any disclaimer, the term of this patent is extended or adjusted under 35 U.S.C. 154(b) by 238 days.

(21) Appl. No.: 14/501,178

(22) Filed: Sep. 30, 2014

(65) Prior Publication Data

US 2015/0096346 A1 Apr. 9, 2015

Related U.S. Application Data

(60) Provisional application No. 61/888,631, filed on Oct. 9, 2013.

(51) Int. Cl.

| | |
|---|---|
| ***B21J 5/08*** | (2006.01) |
| ***E21B 7/04*** | (2006.01) |
| ***B21K 21/12*** | (2006.01) |
| ***B21J 9/08*** | (2006.01) |
| ***B21D 41/00*** | (2006.01) |

(Continued)

(52) U.S. Cl.

CPC .. *B21J 5/08* (2013.01); *B21J 9/08* (2013.01); *B21K 21/12* (2013.01); *E21B 7/046* (2013.01); *B21D 41/00* (2013.01); *E21B 17/042* (2013.01)

(58) Field of Classification Search

CPC ..... B21J 5/08; B21J 9/08; B21J 13/08; B21J 9/06; B21K 21/12; B21C 37/16; B21C 37/28; B21C 23/085; B21C 23/14; F16L 5/02; F16L 15/004; F16L 2201/00; E21B 17/04; E21B 43/105; E21B 43/106

See application file for complete search history.

(56) References Cited

U.S. PATENT DOCUMENTS 4,192,167 A * 3/1980 Huebner ..... B21D 41/00 72/356

4,487,357 A 12/1984 Simon (Continued)

FOREIGN PATENT DOCUMENTS

WO 2012/150564 A1 11/2012

*Primary Examiner* — Peter DungBa Vo

*Assistant Examiner* — John S Lowe

(74) *Attorney, Agent, or Firm* — Whitaker Chalk Swindle & Schwartz PLLC; Charles Gunter

(57) ABSTRACT

Shown is a method for manufacturing horizontal directional drilling pipe having internally and externally upset pipe ends. The forging is done by heating the green tube ends and applying pressure using a closed die hydraulic forging press to form the upsets. One end of a steel tube is worked by upsetting and pressing to form an external upset portion having an outer taper being shaped by upset forging. That portion is then pressed by an internal upset die so as to displace the outer taper to an internal upset portion having an inner taper. Internal upset forging is then carried out by an internal upset die to produce the finished part. The process allows the manufacturer to produce a thicker upset horizontal directional drilling pipe, where the ratio of the outside diameter to the inside diameter of the upset can be on the order of 3.5, or even greater.

3 Claims, 5 Drawing Sheets

(51) Int. Cl.
*E21B 17/04* (2006.01)
*E21B 17/042* (2006.01)

(56) References Cited

U.S. PATENT DOCUMENTS

| | | | | |
|---|---|---|---|---|
| 4,845,972 | A * | 7/1989 | Takeuchi | B21K 21/12 72/306 |
| 5,184,495 | A | 2/1993 | Chunn et al. | |
| 5,361,846 | A | 11/1994 | Carlin et al. | |
| 5,517,843 | A | 5/1996 | Winship | |
| 5,826,921 | A | 10/1998 | Woolley | |
| 6,244,631 | B1 * | 6/2001 | Payne | F16L 15/001 285/333 |
| 6,808,210 | B1 | 10/2004 | Harrison et al. | |
| 7,610,667 | B2 | 11/2009 | Hashem | |

* cited by examiner

PROCESS FOR UPSET FORGING OF DRILL PIPE AND ARTICLES PRODUCED THEREBY

CROSS REFERENCE TO RELATED APPLICATIONS

The present application claims priority from a previously filed provisional application, Ser. No. 61/888,631, filed Oct. 9, 2013, entitled "Process For Upset Forging Of Drill Pipe And Articles Produced Thereby," by Klane E. Kirby and Gregory L. Adkins.

BACKGROUND OF THE INVENTION

1. Field of the Invention

The present invention relates generally to a process for internally and externally upsetting the ends of a metal tube to form a drill pipe, particularly where the tube is used to form a section of upset horizontal directional drilling drill pipe.

2. Description of the Prior Art

Metal tubes which are used to form drill pipe of the type under consideration may have tube ends which are externally upset, internally upset, or both externally and internally upset, depending upon the end application. There are important differences in this regard, between traditional oil field drill pipe and the so-called "horizontal directional drilling" (HDD) drill pipe. Today, most oil field drill pipe is both internally and externally upset, for example to obtain the thickest possible wall for welding to a tool joint. Horizontal Directional Drilling (HDD) drill pipe is typically shorter and of smaller diameter than oil field drill pipe. Also, in the case of HDD drill pipe, the ends may be machined directly, without welding on a tool joint. As s result, the upset region of the HDD drill pipe tends to be relatively long, as compared to the upset region of oil field drill pipe. For example, a typical section of traditional HDD drill pipe might be approximately ten feet long with a pin end that is relatively long compared to the overall length of the section of pipe, for example, approximately 9 inches long.

There are two main processes for upset forging of metal tubes in general, the mechanical, impact process, and the hydraulic upset forging process. The impact process is accomplished by heating the end of the tubes, with an impact punch being used to form the upset on the pipe end. In the case of a drill pipe, the upset region is then threaded to produce a finished product. This process has been used for many years in both the oil field and the HDD industries. However, a chief limitation of the impact process for producing HDD product is that the method is restricted to relatively large internal diameter tubes because of the impact nature of the process used in making the upset. The smaller diameter tubes tend to break the impact punch and cause other problems. These limitations have kept HDD drill pipe manufacturers from being able to thread certain of the smaller internal diameter OEM thread designs, such as the Ditch Witch™ or the common IF™ thread.

The other process for upset forging of metal tubes uses a slow, consistent hydraulic pressure to form the upset. So called "closed die"forging machines are known which are hydraulically actuated to open and close dies and to provide the forging forces. Large hydraulic pumping capacities are typically required, since the dies must move through a substantial distance between the closed position and the open position in which finished parts are removed and subsequent blanks are inserted for subsequent working. While the closed die forging method has found use in a number of industries in forging metal parts, this method has not, to Applicant's knowledge, previously been used in the HDD pipe industry.

The present invention has as one object to overcome certain of the deficiencies noted with respect to the use of the impact forging method in forming HDD drill pipe with upset ends.

Another object of the invention is to adapt a closed die forging method to the manufacture of HDD product, the HDD product having a relatively smaller internal diameter in the threaded upset region than has previously been achievable with the impact forging process.

SUMMARY OF THE INVENTION

In the method of the present invention, a closed die forging method is used to manufacture HDD drill pipe having internally and externally upset pipe ends. Hydraulic pressure is applied using a hydraulic forging press to form a pipe end which has an upset external diameter and an upset internal diameter, a portion of the upset internal diameter being subsequently threaded to form the threaded internal bore. The ratio of the external diameter to the internal diameter in the region of the threaded internal bore is greater than about 3.0, and preferably is on the order of 3.5, or even greater. The forging is done by heating the green tube ends and using the consistent, slow hydraulic pressure of a hydraulic press to form the upsets. In a typical operation, one end of a steel tube is worked by upsetting and pressing to form an external upset portion having an outer taper being shaped by upset forging. Next, the external upset portion is pressed by an internal upset die so as to displace the outer taper to an internal upset portion having an inner taper. Internal upset forging is then applied by the internal upset die, thereby forming a desired length of inner taper and the curvature of a starting point of the portion having the inner taper.

Use of the closed die forging method allows HDD product to be formed having a much smaller internal diameter within the upset region of the pipe ends, allowing the manufacturer to thread all of the types of threaded connections typically found in the industry. Novel HDD drill pipe products are produced having dimensions not possible using the prior art manufacturing techniques. By way of example, the external upset area on the pin end of the pipe might be on the order of only about 4.7 inches in length, as compared to the 9 inch upset on a prior art pipe. The internal diameter might be on the order of only 0.875 inches, as compared to a 1¼ inch internal diameter on the prior art impact forged pipe end. The process of the invention allows the manufacturer to produce a thicker upset, where the ratio of the outside diameter to the inside diameter is about 3.5 or greater.

Additional objects, features and advantages will be apparent in the written description which follows.

DETAILED DESCRIPTION OF THE INVENTION

Figure 1A:
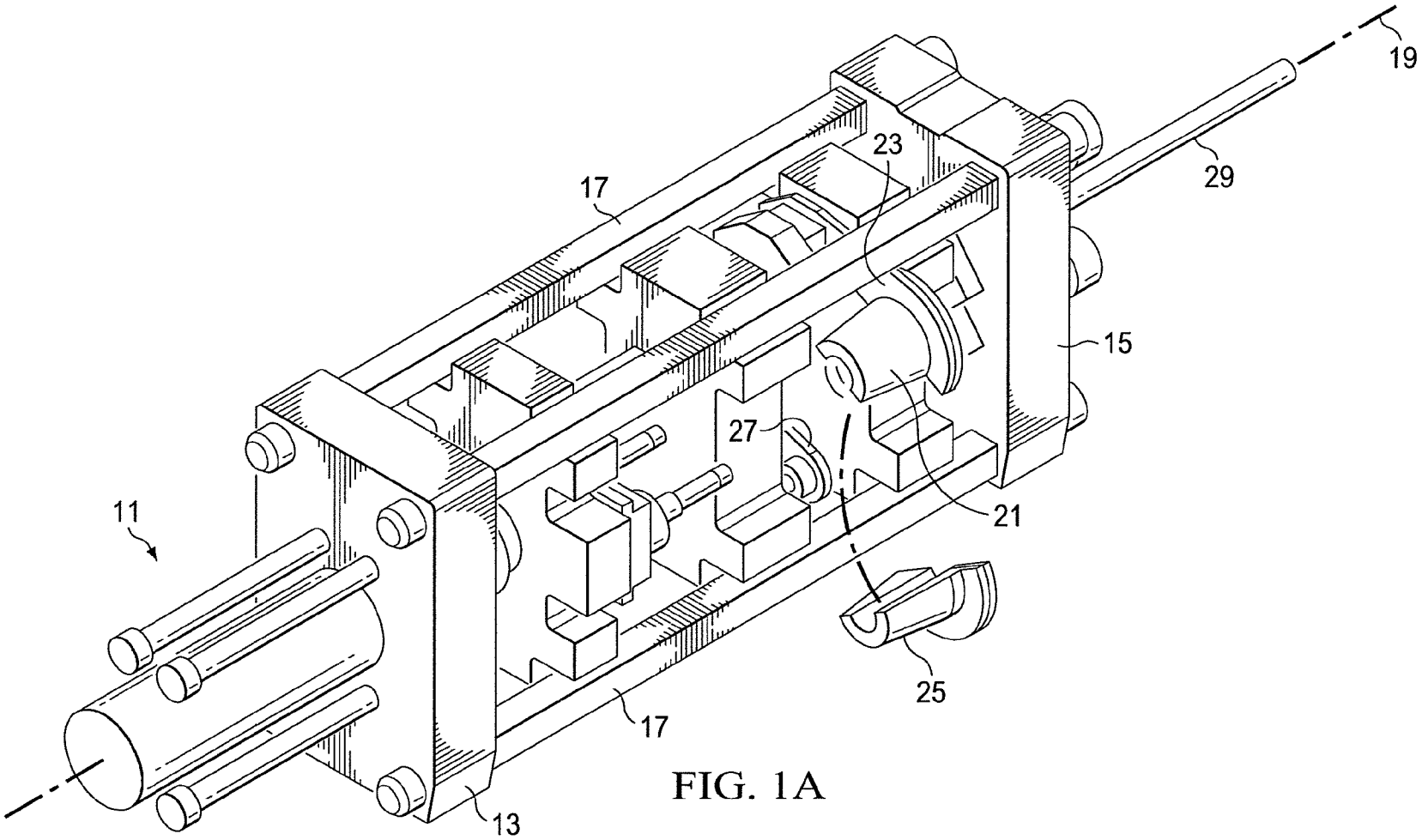
FIG. 1A is a simplified perspective view of a closed die forging machine of the type used in the practice of the present invention.

The preferred version of the invention presented in the following written description and the various features and advantageous details thereof are explained more fully with reference to the non-limiting examples and as detailed in the description which follows. Descriptions of well-known components and processes and manufacturing techniques are omitted so as to not unnecessarily obscure the principle features of the invention as described herein. The examples used in the description which follows are intended merely to facilitate an understanding of ways in which the invention may be practiced and to further enable those skilled in the art to practice the invention. Accordingly, the examples should not be construed as limiting the scope of the claimed invention.

As briefly discussed in the Background portion of the present Specification, horizontal directional drilling (HDD) drill pipe differs in several respects from oil field (oil and gas) drill pipe. Wikipedia® breaks down the definition of directional drilling (the practice of drilling non-vertical wells or holes) into three main groups: (1) oilfield directional drilling; (2) utility installation directional drilling (HDD); and (3) directional boring which intersects a vertical well target, typically to extract petroleum products. "Trenchless technology" is a type of HDD typically associated with subsurface construction work that requires few trenches or no continuous trenches and is a growing sector of the construction and civil engineering industries. It can be defined as ""a family of methods, materials, and equipment capable of being used for the installation of new or replacement or rehabilitation of existing underground infrastructure with minimal disruption to surface traffic, business, and other activities. Trenchless construction includes such construction methods as tunneling, microtunneling (MTM), horizontal directional drilling (HDD) also known as directional boring, pipe ramming (PR), pipe jacking (PJ), moling, horizontal auger boring (HAB) and other methods for the installation of pipelines and cables below the ground with minimal excavation.

As briefly discussed in the Background section, because of the differences in trenchless horizontal directional drilling and traditional oil field drilling practices, HDD drill pipe tends to be shorter and of smaller diameter than oil field drill pipe. Whereas oil field drill pipe is typically both internally and externally upset to accommodate welding on a tool joint, HDD drill pipe ends are typically machined directly, without welding on a tool joint. As a result, the upset region of the HDD pipe tends to be relatively long, as compared to the upset region of oil field drill pipe. As has been mentioned, a typical section of HDD pipe might be, for example, approximately ten feet long with a pin end that is relatively long compared to the overall length of the section of pipe, for example, approximately 9 inches long.

The present invention has as a principal object to overcome certain of the deficiencies noted with respect to the use of the impact forging method in forming HDD drill pipe with upset ends. While the impact forging method may produce acceptable results for oil field drill pipe with welded-on tool joints, it suffers from various disadvantages in producing HDD drill pipe of the type used in trenchless operations, especially where small internal diameter pipe is concerned. The present invention is thus concerned with providing an improved manufacturing process, using a closed die forging method as opposed to an impact forging method, for producing a HDD product, the HDD product having a relatively smaller internal diameter in the threaded upset region than has previously been achievable with the impact forging process.

Turning to FIG. 1 of the drawings, there is shown, in simplified fashion, a hydraulically operated, closed die forging press of the type used in the practice of the present invention. The illustration depicted in FIG. 1 is merely intended to illustrate, in simplified fashion, the principal components used in the practice of the closed die forging method. The construction and operation of such presses is described, for example, in U.S. Pat. No. 4,845,972, to Takeuchi et al.; U.S. Pat. No. 5,184,495, to Chunn et al.; and in WO 2012/150564 to Camagni, to give several examples. Traditional hydraulic presses comprise a supporting structure which defines a longitudinal axis along which the "green pipe" or "tube" to be upset is arranged. The green tube is inserted in the press after the end to be upset has been heated in a few minutes from ambient temperature to a temperature of, for example, 1200° C. After having been inserted in the press, the pipe is blocked by means of locking means which keep it in a predetermined position along the longitudinal axis The end to be upset is closed between a pair of half dies which define a complete die set for the upset material. With this regard, upsetting is carried out by means of the action of a punch or mandrel which enters into the pipe axially at the end to be upset. In particular, the punch has a first tapered portion the larger diameter of which is substantially equivalent to or smaller than that of the inner cavity of the pipe and a second portion of diameter larger than the inner diameter of the pipe and substantially equivalent to the outer diameter of the upset pipe. The penetration of the second cylindrical portion into the end causes the local compression of the heated metallic material, which is reallocated according to the shape of the die. The locking means of the half dies allow the latter to maintain the correct position during punch penetration. The punch operation is normally actuated by means of a piston which operates at a second side of the press opposite to the side where the pipe being machined is inserted and extracted.

The actual upsetting operation may consist of one or more steps. In the case of a one step operation, upsetting is completed with a single die and a single penetration of one punch after heating. In the two step case, the upsetting process includes a first upsetting made by means of a first die and a first punch, and a second upsetting, immediately after the first, made by means of a second die, different from the first, and a second punch, different from the first. Depending upon the application, the green pipes may require a third upsetting of the same end, i.e. three steps, with one or more steps being normally made after having heated the end to be upset a second time.

In traditional hydraulic upsetting presses, the dies are supported by appropriate die holding means rigidly connected to the supporting structure of the press. These die holding means move the half dies between a closing position about the end to be upset and an opening position, in which the half dies are separated and can thus be cooled and lubricated. This opening condition of the half dies allows the pipe to move into and out of the press. In nearly all cases, the half dies maintain a position substantially inside the supporting structure of the press also in the opening position thereof.

FIG. 1 shows a typical two step upsetting press 11 of known type, described in the forgoing WO2012/150564, previously mentioned. The press 11 comprises a supporting structure defined by a pair of crosspieces 13, 15 connected by longitudinal beams 17 parallel to the longitudinal axis 19 of the press. The press 11 comprises a pair of upper half dies 21 each supported by first arms 23 rotating about a same rotation axis, connected in position over the longitudinal axis 19 of the press, so as to move the upper half dies 21 between the closing condition and the opening condition. The same press 11 also comprises a pair of lower half dies 25 supported by second arms 27 rotating about a rotation axis, connected in position under the longitudinal axis 19 of the press 11, so as to move the lower half dies 25 between the closing position and the opening position.

Figure 1B:
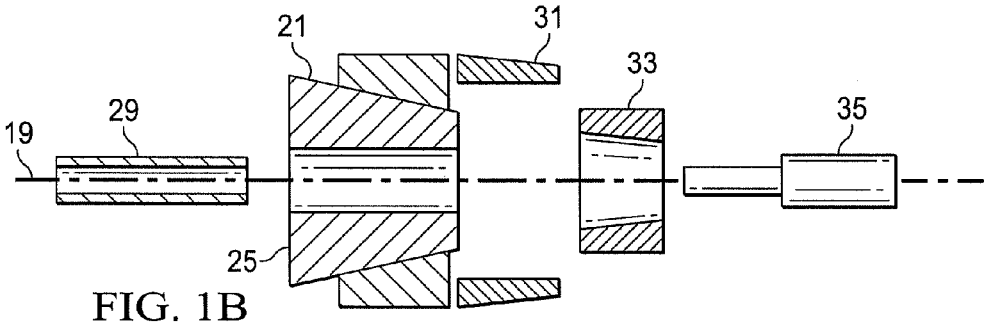
FIGS. 1B-1E are simplified schematic views of the steps employed in a simple, closed die forging operation.
Figure 1C:
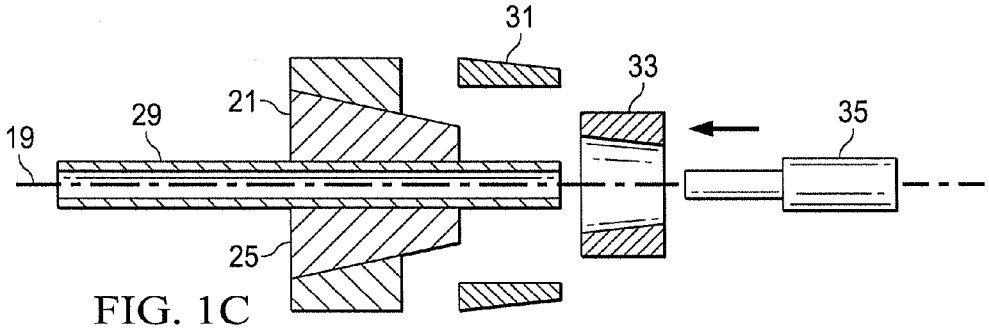
Figure 1D:
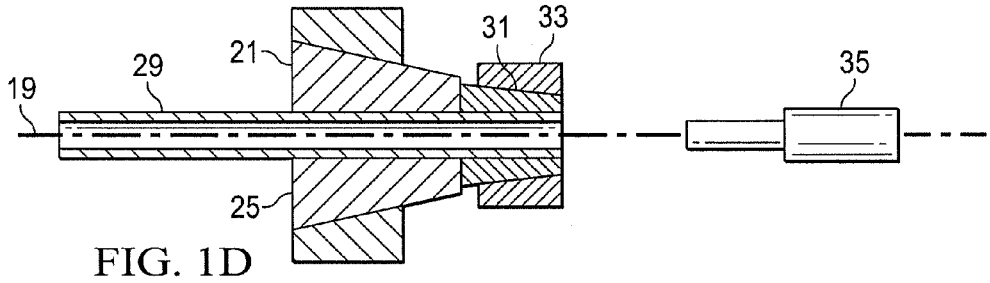
Figure 1E:
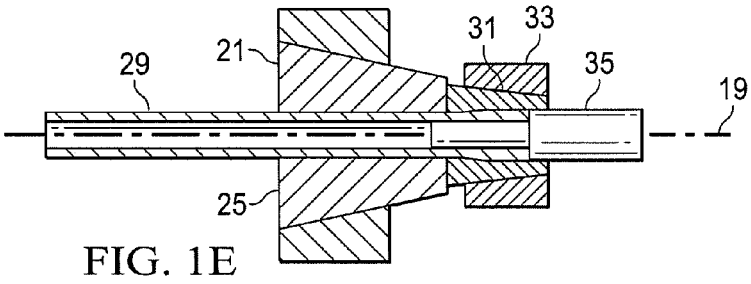

FIGS. 1B-1E illustrate the operation of the press components in schematic fashion. FIG. 1B shows the green pipe end 29, the upper and lower half dies 21, 25, the cross head components, and the mandrel or punch 35 used to form the internal diameter of the tube. In FIG. 1C, the green tube 29 has been heated and is engaged by the upper and lower half dies 21, 25. FIG. 1D shows the engagement of the cross head components 33. In FIG. 1E, the punch 35 is being used to form the internal diameter of the tube 29.

An actual machine suitable for the practice of the present invention is commercially available as the SMS Meer Hydraulic Upsetter™ from the SMS Meer Group, 210 West Kensinger Drive, Suite 300, Cranberry Township, Pa. 16066. This machine can be provided as a complete upsetter package including the induction heating unit and the handling equipment. With an 800 KW heater unit, the machine can produce on the order of 50 ends per hour (assuming 3 upset operations per part). The machine has a centrally located tube clamping device and a variable stroke, both of which contribute to improved tolerances when compared to a mechanical upsetter. There are also no radial fins produced, therefore no additional grinding is required.

With further reference to FIGS. 1A-1E, in a typical closed die forging operation, green tubes are loaded on, for example, the right hand side of the machine by a pipe handling apparatus and progress through, for example, three induction heating coils. They are then collected by tongs and moved to the center line of the machine. The tongs then feed the pipe into the dies of the hydraulic upsetter. Forging occurs and then the tongs remove the pipe from the dies. If the part is finished, it is transferred onto a cooling conveyor. If further forging is required, the tongs return the pipe to the heating coils for re-heat while the machine swings a further set of tooling into the line for finish forging. The part is then finish forged and placed onto the conveyor.

Figure 2A:
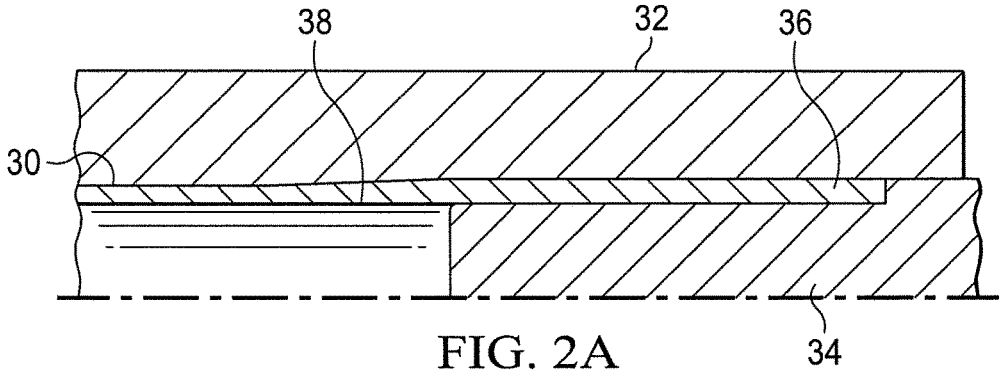
FIGS. 2A-2D are quarter sectional views of the steps used in forming a typical externally and internally upset pipe end.
Figure 2B:
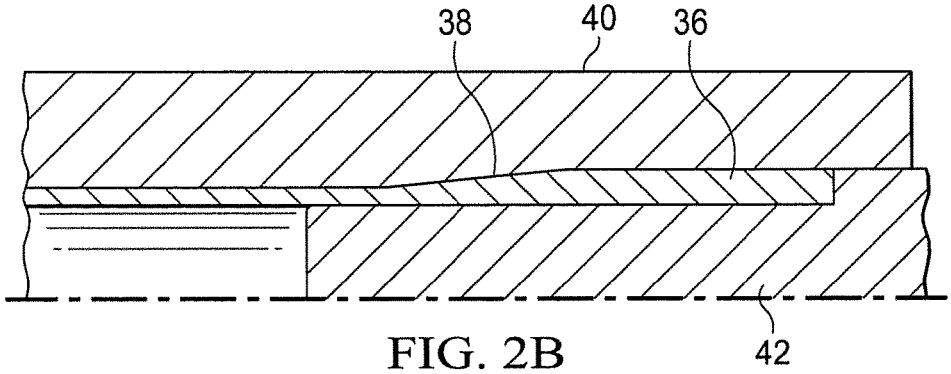

FIGS. 2A-2D illustrate the actual steps employed in forming a pipe end with internal and external upsetting, as described in the previously referenced U.S. Pat. No. 5,184,495. FIG. 2A shows the first step of the method in which the end of tube 30 is externally upset using die 32 and mandrel 34. In this step, cylindrical section 36 of the tube wall adjacent the end of the tube is increased in thickness and conical section 38 is formed to provide the transition between cylindrical section 36 of increased diameter and the tube. In the second step shown in FIG. 2B, die 40 combines with mandrel 42 to increase the thickness of cylindrical section 36 which also increases the angle of the taper of conical section 38.

Figure 2C:
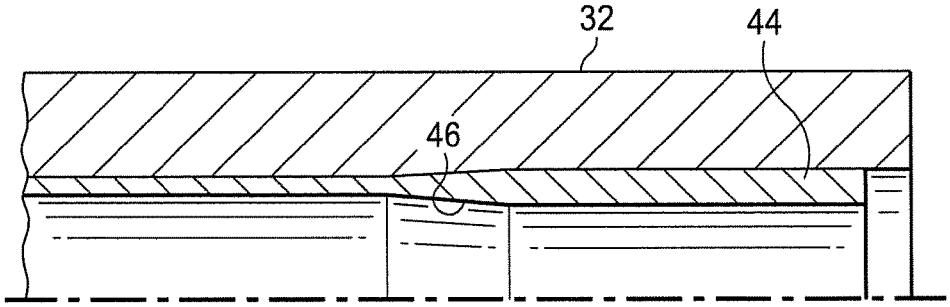

After the second step, the end of the tube is reheated to the original forging temperature (about 2200° F.) after which it is subjected to the third step of the process. As shown in FIG. 2C, die 32 (the same die that is used in the first step) is used alone in this step to press the metal inwardly that had been moved outwardly in steps 1 and 2. Before the die is closed, however, the tube is moved axially to the right to position cylindrical section 36 and conical section 38 in the cylindrical section of the die. This results in cylindrical section 44 having inside and outside diameters that are less than that of section 36 and a conical section 46 having a long tapered internal surface extending between the internal wall of cylindrical section 44 and the non-upset tube wall.

Figure 2D:
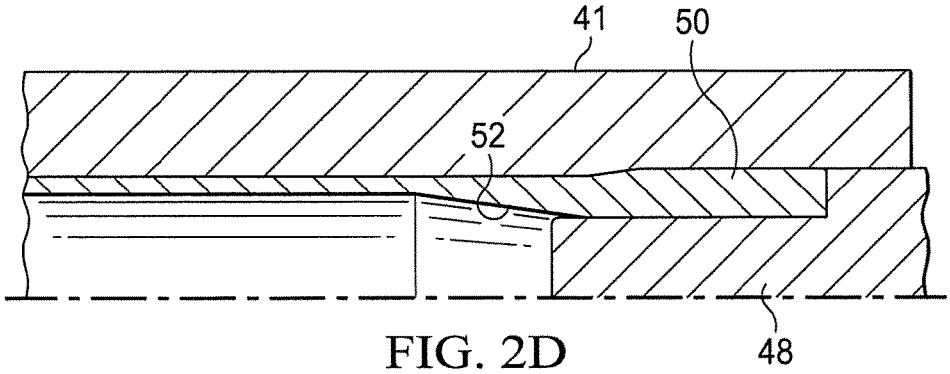

In the final and fourth step, shown in FIG. 2D, mandrel 48 combines with fourth step die 48 to shorten cylindrical section 44 thereby forming cylindrical section 50 having a thicker wall and smaller inside diameter and conical section 52 having a longer internal taper than conical section 46.

Figure 3A:
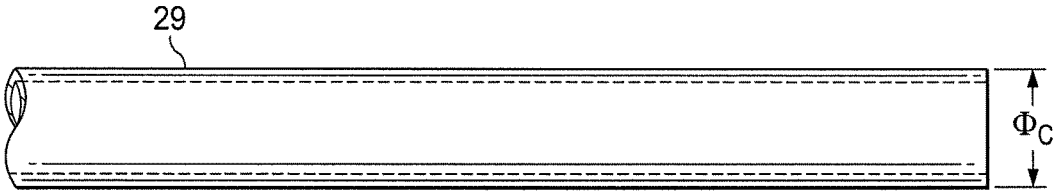
FIG. 3A shows a green tube used in the method of the present invention.
Figure 3B:
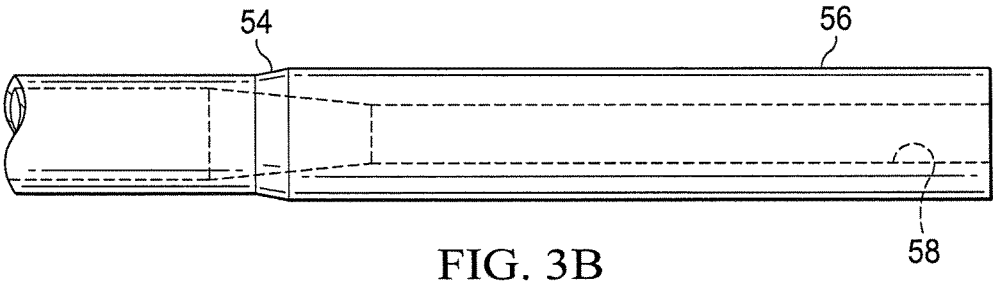
FIG. 3B shows the first steps involved in the closed die forging process of the invention.
Figure 3C:
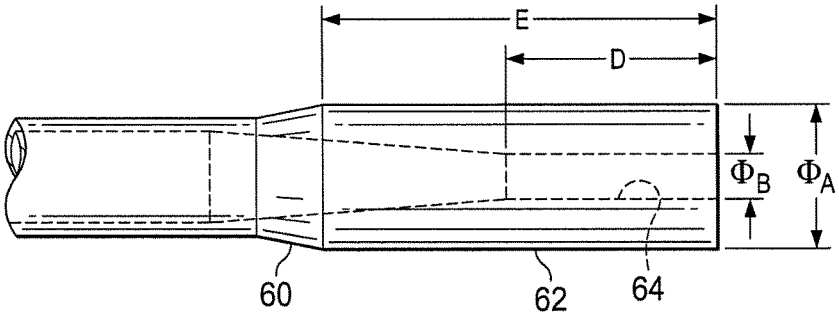
FIG. 3C shows subsequent manufacturing steps in the closed die forging process employed in the practice of the present invention.

The foregoing description is for a section of oil field pipe having externally and internally upset ends. However, the dimensions of the upset regions shown for the oil field pipe and not suitable for HDD applications. FIGS. 3A-3C show the results obtained by applying the hydraulic, closed die forging method to the production of relatively small diameter HDD drill pipe. By "relatively small diameter" is meant generally less than about 1½ inch internal diameter.

FIG. 3A shows the green tube prior to heating. FIG. 3B shows the results of the tube being heated and then placed in the first set of dies to form the first upset. The surfaces formed by the first set of dies are indicated at 54, 56, respectfully. The surface formed by the first mandrel is shown at 58. FIG. 3C shows the surfaces formed by the second set of dies at 60, 62, respectfully, which achieves the second upset. The internal surface formed by the second mandrel is shown at 64.

With reference to FIG. 3C, the ratio $\phi_A/\phi_B$ is the ratio of the outside diameter to the inside diameter in the region of the threaded internal bore of the pipe. It will be appreciated that typical mechanical punch forging operations with relatively long upsets can achieve acceptable results where the $\phi_A/\phi_B$ ratio is less than about 3.5, for example, 2.4 in one case. The closed die forging method of the invention can produce relatively long upsets where the $\phi_A/\phi_B$ ratio is greater than 2.5, preferably greater than 3.0, most preferably on the order of about 3.5, or in some cases even greater. By relatively "long" upset is meant where the length D in FIG. 3C is greater than 30% of the length E.

Figure 4:
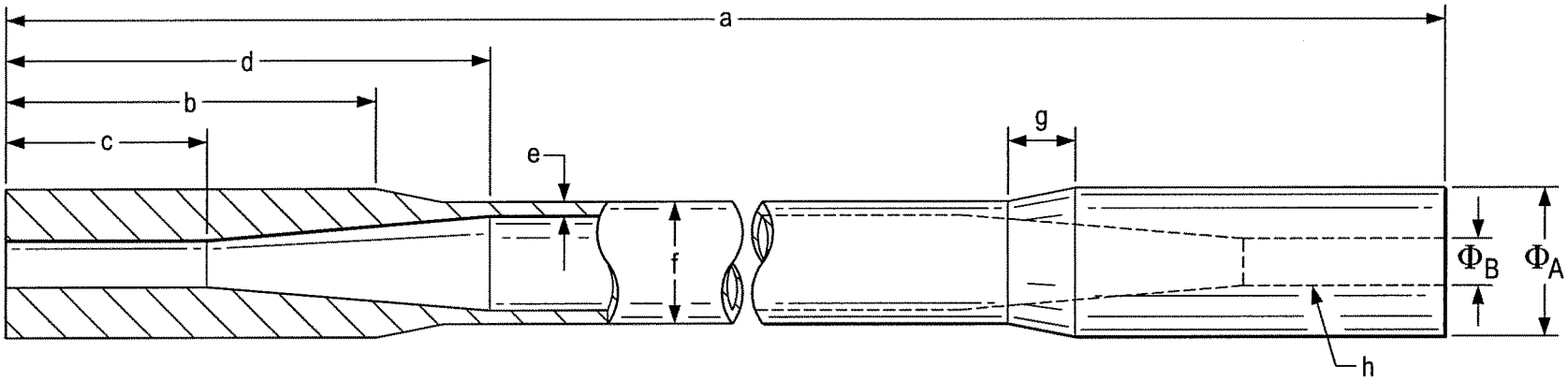
FIG. 4 is a side, partial sectional view of a section of HDD drill pipe produced using the method of the invention and illustrating the novel characteristics thereof.

FIG. 4 is a sectional view of an actual forged section of HDD drill pipe formed according to the method of the invention. The region of the internal diameter that will be subsequently threaded is the region indicated as $\phi_B$ in FIG. 4. The exemplary dimensions are given in Table I below:

| Parameter | Measurement |
|---|---|
| a | 123.6 inches |
| b | 8.00 inches |
| c | 4.34 inches |
| d | 10.5 inches |
| e | 0.254 inches |
| f | 2.375 inches |
| g | 1.50 inches |
| h | 0.010 inch taper/inch |
| $\phi_A$ | 3.00 inches |

-continued

| Parameter | Measurement |
|---|---|
| $\phi_B$ | 0.875 inches |
| $\phi_A/\phi_B$ | 3.43 |

Note that the $\phi_A/\phi_B$ ratio in the above example is "on the order of" or approximately 3.5, i.e., 3.43. This is what Applicant intends by the description "on the order of 3.5" In any event, the ratio achieved through the method of the invention will be greater than the prior art ratio's which, as in the example given above, were on the order of 2.4. It will be understood that this example is merely intended to illustrate the principles of the method of the invention as applied to a particular piece of HDD drill pipe. The specific dimensions will vary, however, depending upon the specific piece of HDD drill pipe being manufactured.

An invention has been provided with several advantages. The closed die forging method of the invention provides an improved method of forming HDD drill pipe, especially pipe having relatively smaller internal diameters. Internal diameters less than ¾ inch are achievable without scrap and without damaging the production equipment. Automated production can produce on the order of 50 ends per hour (assuming 3 upset operations per part). The closed die forging machine has a centrally located tube clamping device and a variable stroke, both of which contribute to improved tolerances when compared to a mechanical upsetter. There are also no radial fins produced, therefore no additional grinding is required. The improved process of the invention produces a thicker upset, where the ratio of the outside diameter to the inside diameter can be on the order of 3.5, or even greater. Forming smaller diameters within the upsets allows the manufacturer of HDD drill pipe to thread all types of needed connections, including connections that are not presently achievable with traditional mechanical, impact forging operations.

While the invention has been shown in only one of its forms, it is not thus limited but is susceptible to various changes and modifications without departing from the spirit thereof.

What is claimed is:

1. A method of forming a section of trenchless horizontal directional drilling drill pipe as a single piece of forged pipe having internally and externally upset pipe ends, the method comprising the steps of:

providing a single section of green pipe having opposing pipe ends and heating at least a selected one of the pipe ends to a predetermined forging temperature;

upsetting and pressing the selected pipe end to form an external upset portion having an outer taper;

pressing the external upset portion with an internal upset die so as to displace the outer taper and form an internal upset portion having an inner taper;

internally upset forging the upset portion with an internal upset die to produce a finished part;

wherein the pressing is accomplished by applying hydraulic pressure using a hydraulic forging press to form a selected upset pipe end which has an upset external diameter and an upset internal diameter, a portion of the upset internal diameter being subsequently threaded to form the threaded internal bore, the ratio of the external diameter to the internal diameter in the region of the threaded internal bore being about 3.5 or greater;

wherein the selected upset pipe end has a first internal diameter of generally uniform diameter, a second flared internal diameter and an outer upset length, and wherein the length of the first internal diameter is greater than 30% of the length of the outer upset length; and repeating the above method steps onto another end of said opposing pipe ends, thereby forming said upset pipe ends.

2. The method of claim 1, wherein the first internal diameter of the selected upset pipe end is less than 1.25 inches.

3. The method of claim 2, wherein the first internal diameter of the selected upset pipe end is about 0.875 inches.

* * * * *